US007358431B1

(12) United States Patent
Monk

(10) Patent No.: US 7,358,431 B1
(45) Date of Patent: Apr. 15, 2008

(54) MUSICAL ACCESSORY MOUNTING DEVICE

(76) Inventor: Elmer W. Monk, 4047 McLean Dr., Cincinnati, OH (US) 45255

( * ) Notice: Subject to any disclaimer, the term of this patent is extended or adjusted under 35 U.S.C. 154(b) by 0 days.

(21) Appl. No.: 11/486,198

(22) Filed: Jul. 13, 2006

(51) Int. Cl.
*G10D 13/08* (2006.01)

(52) U.S. Cl. ..... 84/402

(58) Field of Classification Search ..... 84/402, 84/403, 410, 421
See application file for complete search history.

(56) References Cited

U.S. PATENT DOCUMENTS 3,974,732 A * 8/1976 Kester, Jr. ..... 84/421
4,981,065 A 1/1991 Cohen
5,703,306 A 12/1997 Liao
6,015,128 A 1/2000 Lombardi
2002/0100358 A1 * 8/2002 Dermeulen ..... 84/421

* cited by examiner

*Primary Examiner*—Kimberly Lockett
(74) *Attorney, Agent, or Firm*—Frost Brown Todd LLC

(57) ABSTRACT

A new and improved mounting system and apparatus is disclosed for quick mount and dismount of musical instrument accessories such as a cowbell, cymbal, and/or tambourine. The accessory mounting system comprises a slotted mounting bracket and an associated tang attached to the musical accessory whereby the associated tang is slipped into the slotted mounting bracket thereby supporting the musical accessory without the need for any setscrews and/or threaded fasteners.

4 Claims, 6 Drawing Sheets

MUSICAL ACCESSORY MOUNTING DEVICE

BACKGROUND OF THE INVENTION

The present invention generally relates an improved mounting device for a musical percussion instrument, such as a cow bell, typically used by a drummer, in a musical performing band or orchestra.

Heretofore, in the prior art, the cow bell 2, generally used by a band drummer, has been mechanically affixed to a music stand 1, as illustrated in FIG. 1, and/or to a drummer's drum stand as typically illustrated in prior U.S. Pat. Nos. 6,015,128 and 5,703,306 respectively.

As seen in the two U.S. patents referenced above, the musical cow bell 2 has been typically affixed, in a relatively permanent fashion to a music stand 1 and/or a drum stand by means of a set screw, or wing nut, clamping type arrangement 3. However, such threaded clamp type cow bell attachments many time vibrate loose and permit the cow bell to fall or slowly slide down the stand upon which the bell is attached.

Depending upon the particular piece of music being played the drummer may desire that the cow bell be located in a particular position relative to his drum set. Thus when changing from one musical selection to another it may be desirable for the drummer to relocate the cow bell. Thus the use of a set screw (or wing nut) or any other type of semi-permanently affixed attachment means, becomes cumbersome and is difficult to accomplish when changes in music selections are made at a fast pace. The drummer many times finds himself fumbling around relocating his cow bell while the band plays on. Further, drummers have experienced finger and/or hand cramping when setting or loosening such screw thread type cow bell attachment means which then affects the drummers performance.

Further, the peasant invention may be use with other percussion instruments, such as a tambourine, a cymbal, etc thereby permitting the drummer to intermittently exchange the cow bell with a tambourine or a cymbal as the particular selection of music may require.

SUMMARY OF THE INVENTION

The present invention solves the above described drummer's problem by disclosing a cow bell mounting system that permits the drummer to easily and swiftly move the cow bell from one position to another without the necessity of fumbling around with time consuming set screws and the like.

The present invention teaches a cow bell mounting system generally comprising an angular tang affixed to the closed end of the cow bell and a slotted mounting bracket whereby the drummer merely inserts the cow bell tang within the slot of the mounting bracket without the need to release and/or fasten the set screws of past mounting systems. Thus the drummer may now swiftly reposition the cow bell between music selections

DETAILED DESCRIPTION OF THE PREFERRED EMBODIMENT

Figure 1:
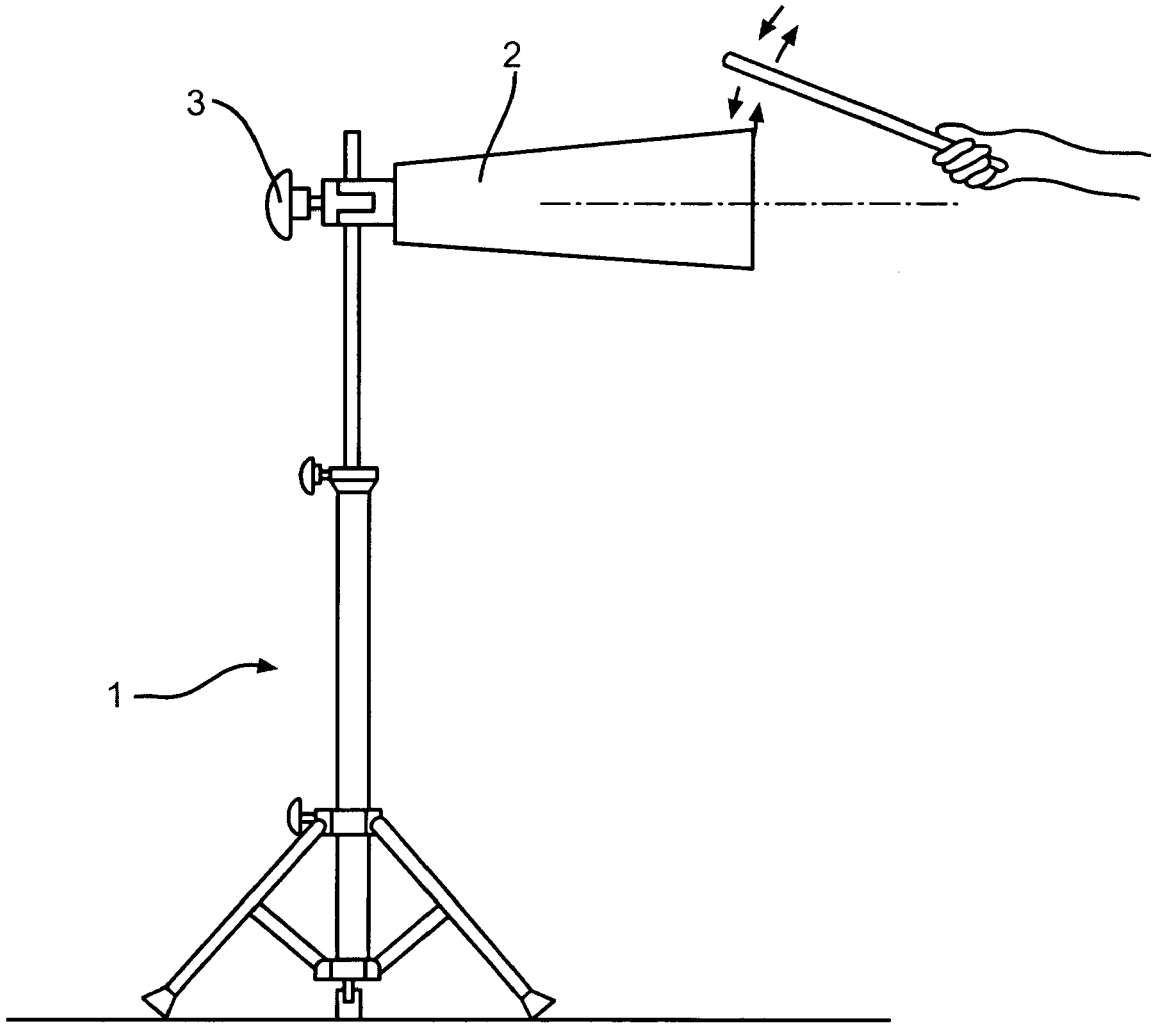
FIG. 1 (PRIOR ART)
FIG. 1 illustrates a prior art device for attaching a musical cow bell to musical stand.
Figure 2:
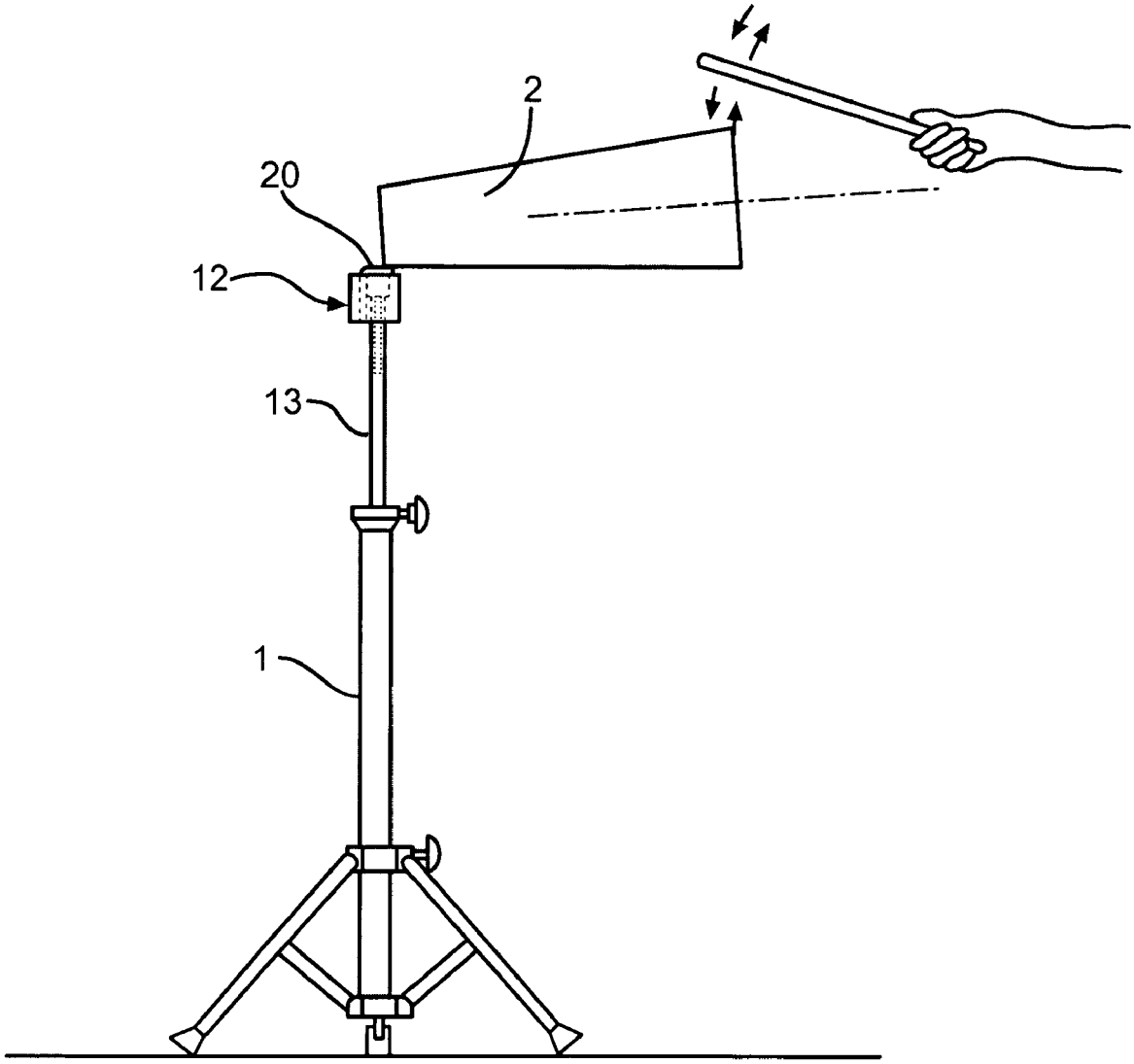
FIG. 2 presents an improved device for mounting a musical cow bell embodying the present invention.
Figure 3:
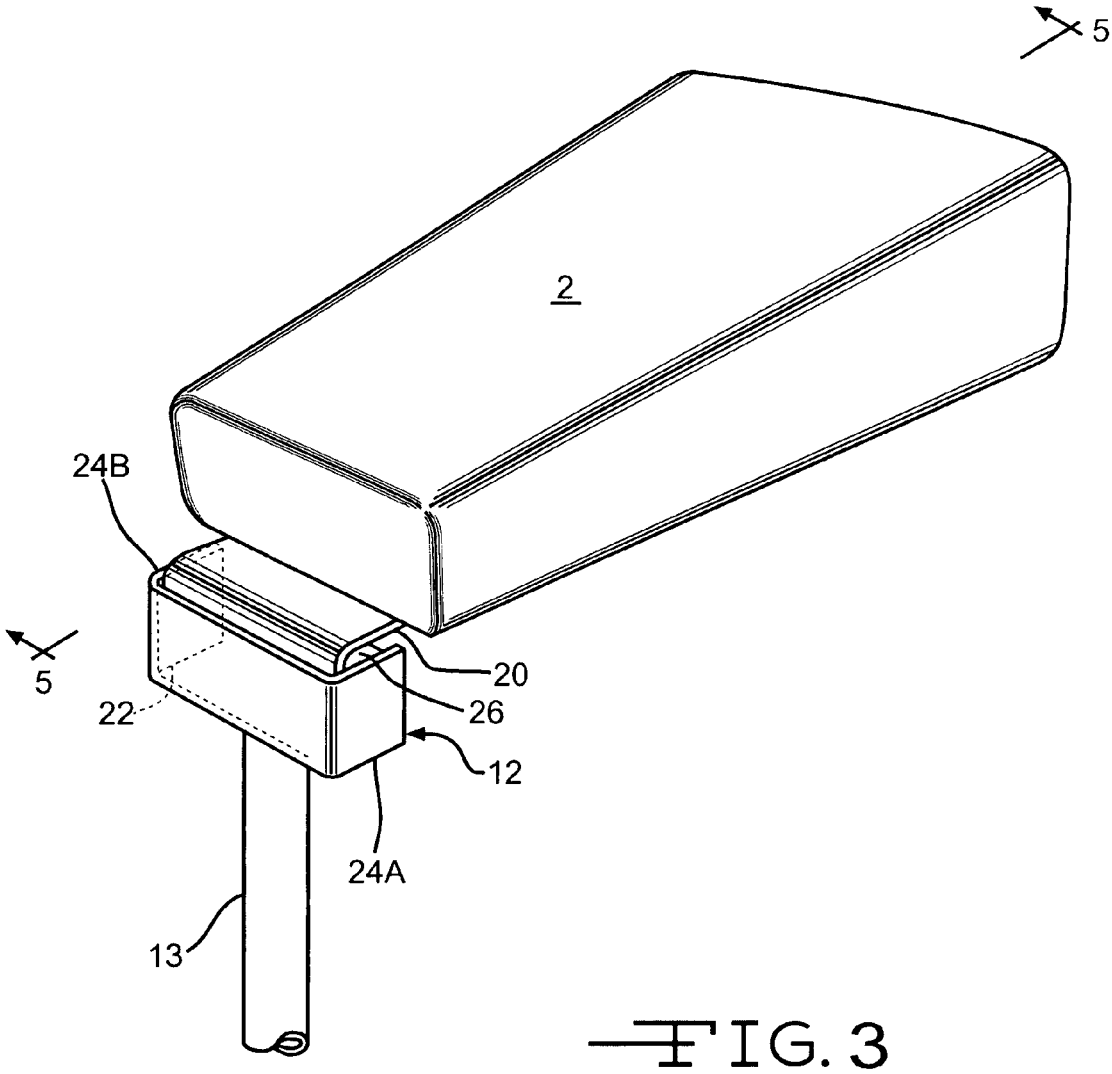
FIG. 3 presents a pictorial view of a musical cow bell including a mounting device embodying the present invention.
Figure 4:
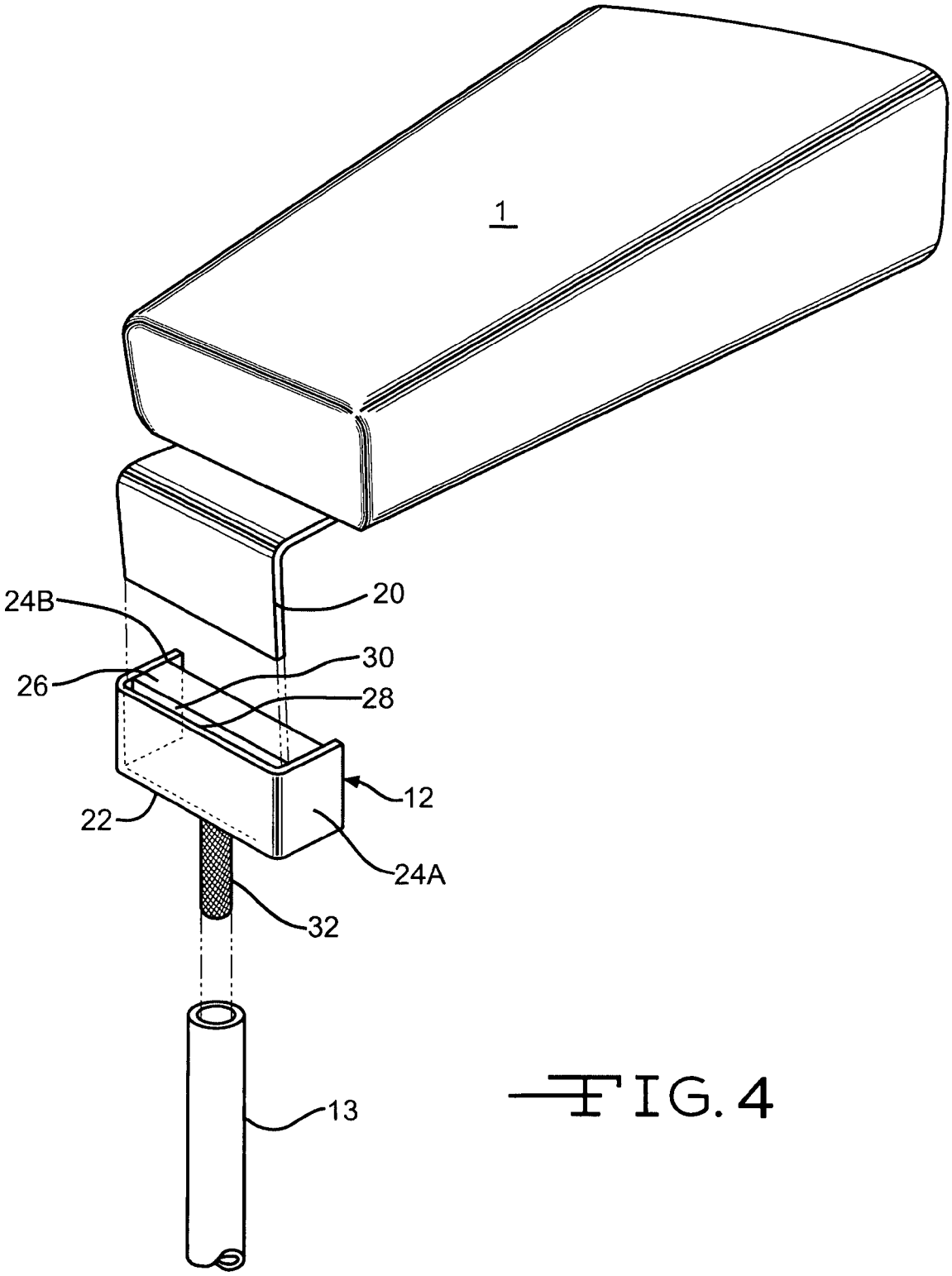
FIG. 4 presents an exploded pictorial view of a musical cow bell and its mounting device embodying the present invention.
Figure 5:
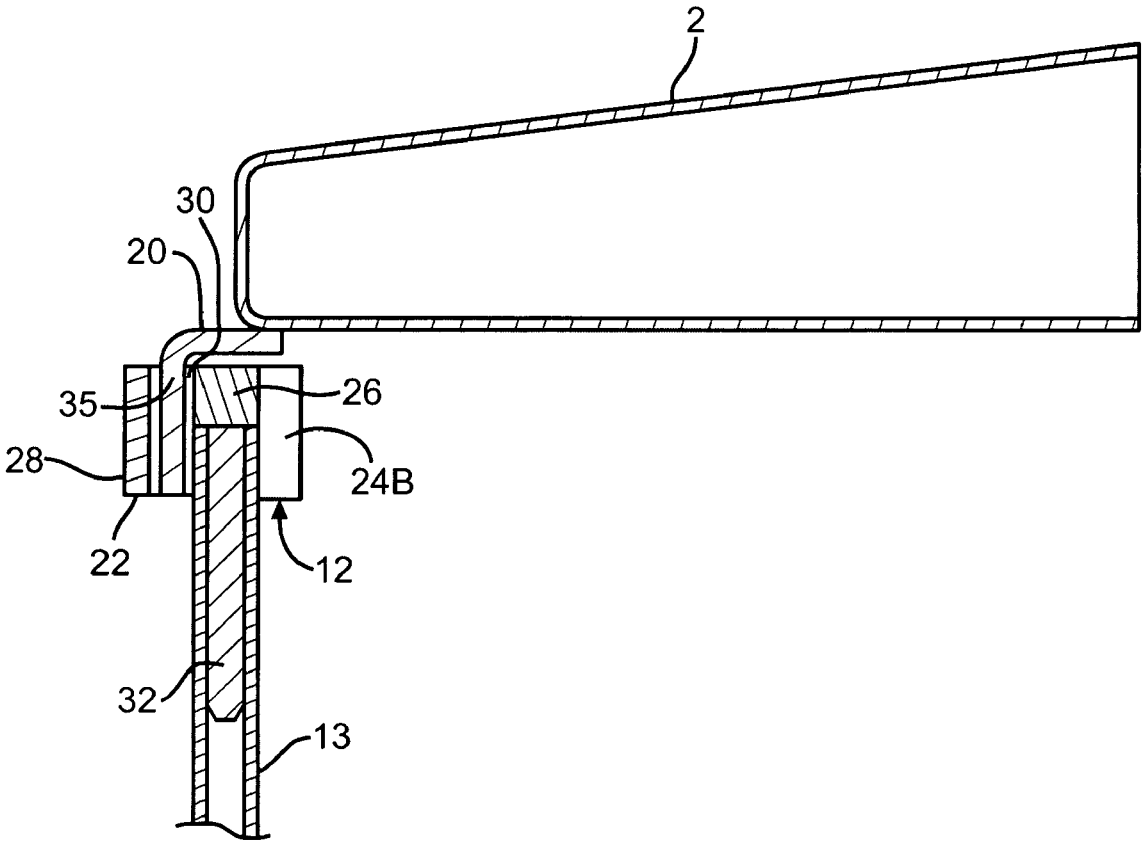
FIG. 5 presents a crossectional view taken along line 5-5 in FIG. 3.
Figure 6:
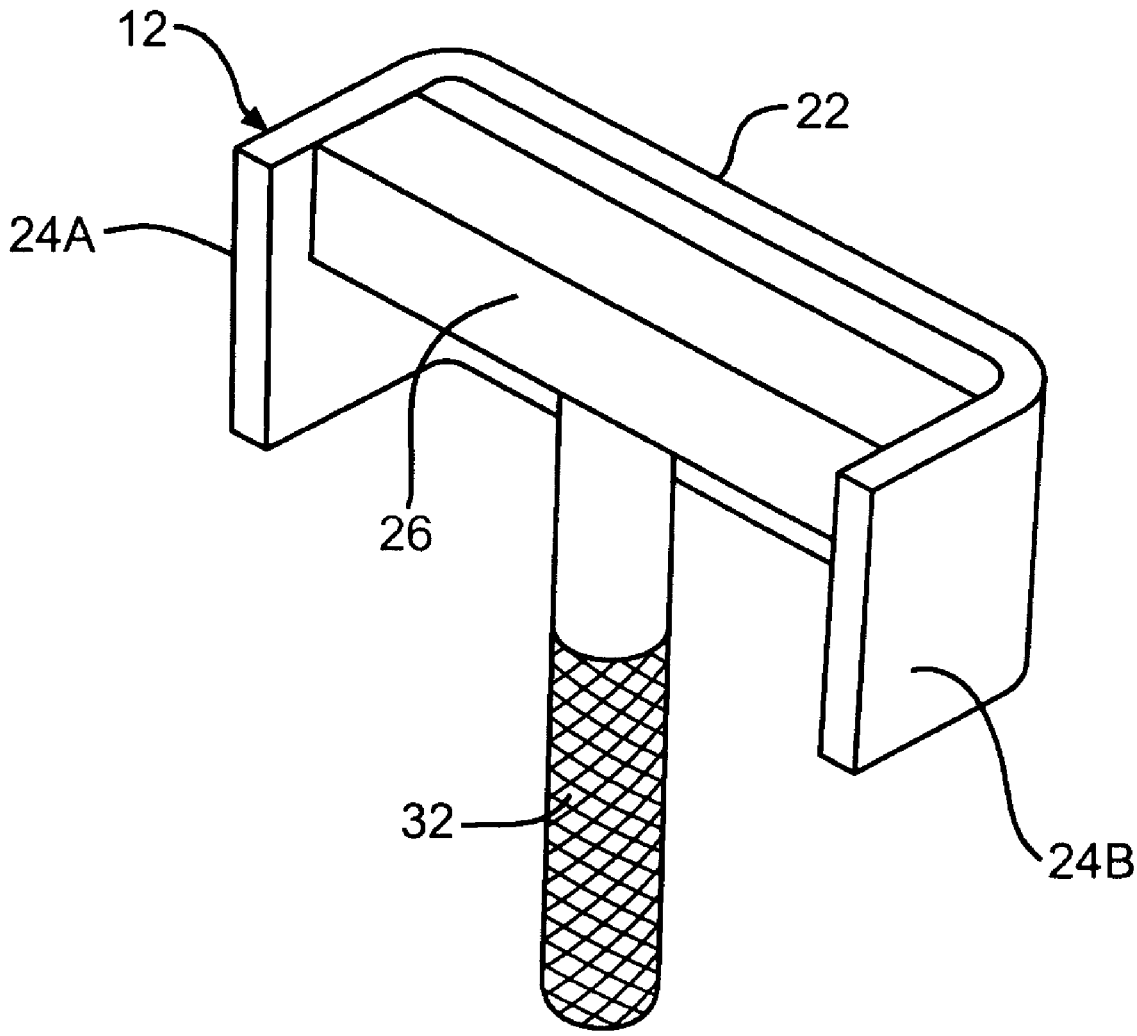
FIG. 6 presents a, reverse angle, pictorial view of the mounting bracket assembly illustrated in FIG. 4.

Referring now to FIGS. 2 through 6, cow bell 2 includes angular bracket 20 permanently affixed to the closed end of cow bell 2 as best illustrated in FIG. 5. Cow bell 2 may be affixed to angular bracket 20 by any suitable means preferably by welding.

Mounting bracket assembly 12 comprises an open ended outer frame 22 formed into a "U" channel shape as best illustrated in FIG. 4. Extending between the opposing legs 24A and 24B, of outer frame 22 is support bar 26. Support bar 26 is permanently affixed to and between legs 24A and 24B by any suitable means, preferably welding. A slot 30 is formed between support bar 26 and the web portion 28 of outer frame 22. Extending downward from support bar 26 is a mounting bracket support rod 32.

Mounting bracket support rod 32 is sized to be telescopingly received within a typical music stand extension tube 13 as best illustrated in FIG. 5.

In operation mounting bracket assembly 12 is telescopingly placed in music stand extension tube 13 as illustrated in FIG. 5 or any other convenient holder. Although not shown, a thumbscrew may be provided to prevent mounting bracket support assembly 12 from rotating within extension tube 13 of music stand 1.

Cow bell 2 may then be easily attached to mounting bracket 12 by inserting the downward directed tang 35 of bell angular bracket 20 downward into slot 30 of mounting bracket assembly 12 as illustrated in FIG. 5.

Although mounting bracket assembly 12 is illustrated as being configured for mounting upon a typical music stand 1, mounting bracket 12 may be easily adapted for mounting upon a drum set or any other convenient supporting device. Thus as the particular music pieces are selectively played the drummer merely removes the cow bell from one mounting bracket and instantly attaches it to another without fumbling around with time consuming set screws or the like.

While I have described above, the principles of my invention in connection with specific embodiment, it is to be clearly understood that this description is made only by way of example and not as a limitation of the scope of my invention as set forth in the accompanying claims.

I claim:

1. Apparatus for holding a musical percussion instrument during use by a musician comprising:

a) a downwardly directed tang (20) affixed to said musical percussion instrument (2), b) a mounting bracket assembly (12) comprising:

1) an open ended outer frame (22), said outer frame including a pair of parallel legs (24A, 24B) and a web (28) extending between said legs (24A, 24B), 2) a support bar (26) extending between said parallel legs (24A, 24B) forming a slot (30) between said support bar (26) and said web (28), 3) a support rod (32) extending downwardly from said support bar (26), whereby said tang (20), affixed to said musical percussion instrument (2) may be removably inserted into said slot (30).

2. The apparatus as claimed in claim 1 wherein said musical percussion instrument is a cow bell.

3. Mounting apparatus for a musical percussion instrument for use by a musician comprising:

a) a mounting tang having a horizontal portion, attached to said musical percussion instrument, and an angularly directed portion thereof, extending away from the plane of said horizontal portion, b) a mounting bracket assembly for receiving therein said angularly directed portion of said mounting tang comprising:

1) a generally "U" shaped frame, said frame including a base web portion and a pair of opposing parallel legs extending outward from said base web, 2) a support bar extending between said parallel legs forming a slot between said support bar and said base web, said slot parallel to said base web, and 3) a support rod extending downwardly from said support bar, said support rod generally perpendicular to said support bar, whereby said angularly directed portion of said tang may be removably inserted into said slot.

4. The apparatus as claimed in claim 3 wherein said musical percussion instrument is a cow bell.

* * * * *